United States Patent [19]

Wang et al.

[11] Patent Number: 4,496,635

[45] Date of Patent: Jan. 29, 1985

[54] AMORPHOUS METAL ALLOY AND COMPOSITE

[75] Inventors: Rong Wang; Martin D. Merz, both of Richland, Wash.

[73] Assignee: The United States of America as represented by the United States Department of Energy, Washington, D.C.

[21] Appl. No.: 360,117

[22] Filed: Mar. 19, 1982

Related U.S. Application Data

[63] Continuation of Ser. No. 138,951, Apr. 9, 1980, abandoned.

[51] Int. Cl.[3] ..... B32B 15/00

[52] U.S. Cl. ..... 428/680; 148/403; 428/681

[58] Field of Search ..... 148/403; 75/123 B; 428/680, 681

[56] References Cited

U.S. PATENT DOCUMENTS 4,255,189 3/1981 Ray ..... 75/123 B

*Primary Examiner*—R. Dean

*Attorney, Agent, or Firm*—James W. Weinberger; Walter L. Rees

[57] ABSTRACT

Amorphous metal alloys of the iron-chromium and nickel-chromium type have excellent corrosion resistance and high temperature stability and are suitable for use as a protective coating on less corrosion resistant substrates. The alloys are stabilized in the amorphous state by one or more elements of titanium, zirconium, hafnium, niobium, tantalum, molybdenum, and tungsten. The alloy is preferably prepared by sputter deposition.

9 Claims, No Drawings

AMORPHOUS METAL ALLOY AND COMPOSITE

CONTRACTUAL ORIGIN OF THE INVENTION

The United States Government has rights in this invention pursuant to Contract No. EY-76-C-06-1830 between the U.S. Department of Energy and Battelle Pacific Northwest Laboratories.

This is a continuation of application Ser. No. 138,951, filed Apr. 9, 1980, abandoned.

BACKGROUND OF THE INVENTION

This invention relates to amorphous metal alloys. More specifically, this invention relates to amorphous iron-rich and nickel-rich chromium alloys which are corrosion-resistant, are stable to relatively high temperatures and which can be applied as coatings for the protection of less corrosion-resistant materials.

Highly corrosive environments require the use of materials which are able to withstand corrosive attack from these environments for extended periods of time. For example, blades and other components in turbines used to generate electrical power from steam recovered from geothermal sources must be able to function in an environment containing high concentrations of sulfur dioxide, chloride ions and other highly corrosive materials.

Corrosion-resistant coatings of amorphous iron-chromium and iron-chromium-nickel based alloys are presently available for the protection of substrates which are subject to attack by their environment. Most of these alloys are stabilized in the amorphous state by one or more of the metalloid elements such as B, C, Si and P. Amorphous or glassy alloys such as these, are very resistant to corrosive attack in a neutral or acid environment at temperatures below about 200° C. At temperatures from 200° to 400° C. the alloy is stable, although it becomes less resistant to corrosive attack. However, annealing most of the alloys at temperatures above 400° C. completely crystallizes the alloy. Once crystallized, the alloy loses its chemical inertness and is subject to corrosive attack just as any normal alloy would be.

In the Journal of Non-Crystalline solids 29 (1978), pages 61–65, the addition of Mo and W to a series of amorphous iron-chromium and iron-chromium-nickel-based stainless steel alloys stabilized with P and C is described. The article discloses that, although the corrosive rate was decreased due to the presence of the Mo and W in the alloy, it was the chromium which provided the most dramatic increase in corrosion resistance. Furthermore, the alloys were stabilized in the amorphous state by P and C, and were subject to crystallization when heated to the higher temperatures.

Thin films of amorphous 304 stainless steel (74% Fe, 18% Cr, 10% Ni, plus small amounts of P, Mn, S and Si) have also been reported in the Journal of Materials Science, 13 (1978) Letters. The films were sputter-deposited on biased substrates cooled to −196° C. or maintained at near room temperature. The films were said to remain amorphous at temperatures up to 800° to 900° C. The films, however, were extremely thin, i.e. about 200 nm thick, to prevent crystallization and therefore are not suitable for substrate protection.

SUMMARY OF THE INVENTION

It has been found that the alloying of certain of the of the early transition elements as stabilizers with iron-chromium, nickel-chromium and iron-chromium-nickel alloys, commonly regarded as stainless steels, makes possible the preparation of amorphous metal alloys which have good corrosion-resistant properties and which also exhibit improved thermal stability over amorphous alloys which are stabilized with the metalloids. Furthermore, it is possible to provide coating thicknesses of 25 μm or greater without affecting the amorphous state. Amorphous metal alloys of the invention have the composition $M_aCr_bT_c$ where M is at least one element selected from the group consisting of Fe an Ni, T is at least one element selected from the group consisting of Ti, Zr, Hf, Nb, Ta, Mo and W, and wherein a is 35–75 atom percent, b is 5–20 atom percent, c is 5–55 atom percent, and b plus c must equal at least 25 atom percent.

The use of the early transition elements as stabilizers permits the conversion of any of the conventional stainless steel alloys to the amorphous state. It has further been found that less chromium can now be used without adversely affecting the corrosion-resistant properties of the amorphous alloy. The alloys have also been found to be resistant to radiation damage at temperatures up to 500° C.

The amorphous alloy of the invention is suitable for providing highly corrosion-resistant and thermally stable coatings on any substrate to which the coating can be applied.

It is therefore one object of the invention to provide an amorphous iron-rich or nickel-rich chromium alloy which is highly corrosion-resistant and has high temperature stability.

It is another object of the invention to provide an amorphous iron-rich or nickel-rich chromium alloy which requires less chromium while remaining highly corrosion-resistant, and thermally stable at higher temperatures.

Finally it is the object of the invention to provide an improved corrosion-resistant, and amorphous iron-rich and nickel-rich-chromium alloy which is thermally stable at temperatures above 500° C. and which can be applied as a protective coating.

DETAILED DESCRIPTION OF THE PREFERRED EMBODIMENT

These and other objects of the invention may be met by an amorphous metal alloy of the composition $M_aCr_bT_c$ where M is at least one element selected from the group consisting of iron and nickel, T is at least one element selected from the group consisting of titanium, zirconium, hafnium, niobium, tantalum, molybdenum and tungsten, where a is from 35–75 atom percent, b from 5–20 atom percent, c from 5–55 atom percent, and b and c are at least 25 atom percent.

The composition of the alloy may vary from an iron-rich chromium alloy such as the stainless steels to nickel-rich chromium alloys such as the super alloys. The amount of iron, nickel or both iron and nickel in the alloy may vary from 35, preferably 50 to 75 atom percent. Preferably, the alloy will contain one of the early transition elements selected from the group of titanium, zirconium, hafnium, niobium, tantalum, molybdenum and tungsten although it may comprise two or more. It is important that the alloy contain at least 25 atom percent chromium plus the stabilizing element and that at least 5 atom percent of this amount be chromium. This is necessary since it has been found that, although chromium alone will not stabilize the alloy, the presence of chromium permits the use of less stabilizing element than is otherwise necessary to permit formation of the amorphous alloy. Furthermore, the use of the transition elements has been found to permit the use of less chromium while retaining the corrosion-resistance of the the alloy. The exact amount of stabilizing element necessary to prepare an amorphous alloy will depend upon the exact alloy composition to be prepared. Thus, the presence of less chromium will require that more transition elements be added while more chromium will require less. For example, 304 stainless steel which contains about 18 atom percent chromium can be stabilized with about 7 atom percent of transition element.

The amorphous alloy may also contain minor amounts of other elements such as sulfur, copper, manganese and silicon, without affecting the properties of the alloy.

The amorphous metal alloy coatings are preferably prepared by a high rate sputter deposition technique onto the desired substrate cooled to below 100° C., although it is possible that certain compositions may be formed at higher temperatures. Other suitable deposition techniques may include ion implantation, ion plating and evaporation.

One type of sputtering apparatus which has found to be particularly suitable for preparing the amorphous metal alloy coatings of the invention and which has a high rate of deposition is a triode sputtering apparatus. In this apparatus, the plasma is formed independently as the positive column of a discharge maintained between a thermionic cathode and an anode and which has a cooled substrate with a controllable negative bias, although biasing is not required. Sputtering is accomplished by inserting a target of the alloy to be formed into this plasma as a separate negative electrode. The targets may be either cast, powder compacts or multielement targets. The advantage of this apparatus is that high-purity deposits and a high sputtering rate are achievable. One such apparatus is described in U.S. Pat. No. 4,038,171 which was issued July 26, 1977.

The substrate may be any material which can be coated by any of the deposition methods, such as metals, ceramics and plastics. It is important that the substrate be cooled during deposition in order that the amorphous alloy will be formed thereupon. The amount of cooling required will depend upon the composition of the alloy being deposited, and the amount of stabilizer present. For example, almost any of the composition ranges can be formed on substrates cooled with liquid nitrogen (−196° C.) while alloys containing up to 50 atom percent of transition metal stabilizers may be prepared on substrates with temperature up to 100° C. or higher.

The amorphous alloys of the invention have been found to be thermally stable up to about 800° C., depending upon the amount of stabilizer element which the alloy contains. The alloys have also been found to be have excellent corrosion-resistant properties as defined by potentiostatic techniques in aqueous solutions containing Cl ions at a pH ranging from 1 to 7. A typical anodic current density is $10^{-5}/cm^2$ or less at near corrosion potential. The low current density is maintained at the high potential from 0 to 1.5 V (SCE) or greater. Even with crystallization of up to 50% of the amorphous state, excellent corrosion resistant properties are still retained in solutions of pH 7 while in solutions of pH 1 the anodic current density increases about one magnitude from that of the 100% amorphous state.

EXAMPLE I

A sputter target was fabricated by embedding four ¼ inch diameter by ¼ inch long tungsten rods into a 3 inch diameter commercial purity 304 stainless steel disc of about ½ inch thickness. The substrate was a 2.5 inch diameter by ½ inch thick copper disc electron beam welded to a stainless stem. The sputtering chamber was helium leak tested and baked at 100° C. for 12 hours. The system pressure after cooling was $3\times10^{-8}$ torr. High purity krypton sputtering gas was then admitted to the chamber and maintained at an indicated system pressure of 1 to $2\times10^{-3}$ torr during the deposition run. The critical surfaces in the sputtering chamber were ion etched to promote adherence of the deposited material and prevent peeling. Both the target and the substrate were water cooled during the deposition run, the substrate being maintained at 20° C. The target voltage was −1,500 VDC and the target current was held at 100 mA for the first 5 minutes of operation and then increased to 200 mA. The plasma was generated using a filament current of 28 to 32 A, a plasma potential of −40 VDC, and plasma current of 3.3 composition to 3.8 A. A 10 mil thick deposit was produced in ten hours. The as deposited material had a composition of $Fe_{62}Ni_9Cr_{18}W_{11}$ and was amorphous as indicated by X-ray difraction. It had a crystallization temperature of 619° C. as measured by differential scanning calorimetry (DSC) at a rate of 20° C. Corrosion samples were cut by electrodischarge machining (EDM) to obtain circular shapes about 1 $cm^2$ in area. The samples were tested by dynamic-potential polarization technique in solutions containing 1M and 0.1M sodium chloride with a pH of 1 or 7. Typical corrosion current is near $10^{-=}A/Cm^2$ and the passivation current near $10^{-6}A/Cm^2$. Comparing this data to crystalline 304 stainless steel, the amorphous alloy was mute to the pitting formation which was found to occur at 0.8 V in the crystalline stainless steel.

EXAMPLE II

Additional samples with the composition $Fe_{54}Ni_7Cr_{16}W_{23}$ were prepared using methods similar to that described in Example I. The corrosion behavior of the samples was studied by polarization curves in chloride solutions with pH values of 1, 4, and 7. For as-deposited amorphous coatings, a passive corrosion current density of $10^{-5}A/Cm^2$ were found at pH values of 7 and 4. No pitting attack was observed even at potentials as high as 1.8 V(SCE). The corroded surfaces were studied with SEM and optical microscopy and no local attack was observed at 500× magnification. The corrosion features at 4000× magnification were high density, shallow dimples connected to one another. These surface features were indicative of total area corrosion in absence of a localized attack. At pH 1, the corrosion current density remained near $10^{-5}A/Cm^2$ for voltages to 0.8 volts. Moreover, even though the current density increased to $10^{-3}A/Cm^2$ near 1.5 volts, no pitting attack was observed.

In order to study the thermal stability of these alloys, several samples of 304 stainless steel containing varying amounts of tungsten as the stabilizer were heat treated at 400° and 500° C. for 24 hours in a vacuum. X-ray defraction indicated that the 10 and 23 atom percent tungsten coating remained amorphous after the 400° C.

exposure and that the 23 atom percent was also completely amorphous after the 500° C. heat treatment. The annealed 10 and 23 atom percent amorphous coatings had even smaller anodic current densities than those of the as deposited coatings between −0.7 to 0.8 volts (SCE) in 1M NaCl, pH 1 solution.

The passive films were studied by SEM and Auger analysis for microstructure and composition of the films. The passive films formed at low voltages, e.g. between −0.8 and 1.0 volts (SCE), were Cr oxides or hydroxides with only small amounts of W incorporated in the films. However, increasing the voltage beyond 1.0 V caused the formation of a mixture of tungsten oxide, and chromium oxide or hydroxide films on the amorphous alloys with more than 23 atom percent W. In this case the passive nature of the amorphous coating and the high voltage region may be attributed to protective films of tungsten oxide.

EXAMPLE III

An additional sample with the composition $Fe_{32}Ni_5Cr_9$ and $W_{54}$ was prepared using the techniques described in Example I. Although this sample contained low chromium, corrosion-resistant measurements indicated the material was still corrosion-resistant especially at the higher potentials ranging from 1 to 2 volts. The thermal decomposition temperature of this material as determined by DSC at 20° C./sec was on the order of 800° C.

EXAMPLE IV

An amorphous metal alloy using titantium as a stabilizing element was prepared by the technique of Example I. The target in this case was a 2 inch diameter 304 stainless steel plate with a 0.5 inch diameter titantium rod inserted in the plate 0.5 inch off center. The purpose of the offset titantium was to form a graded composition in the coating. A 7 mil thick coating was produced in 5 hours at an average deposition rate of 1.4 mils per hour. The composition of the coating was determined by X-ray elemental analysis with a scanning electron microscope. The chemical composition of the coating varied from $Fe_{65.2}Cr_{18.6}Ni_{6.6}Ti_{9.6}$ or (SS 304)90.4 $Ti_{9.6}$ at a point opposite the Ti in the target, to $(SS\ 304)_{94.6}Ti_{5.4}$ 5/8 inch away from this point. In an intermediate area, the composition was $(SS\ 304)_{92.6}Ti_{7.4}$. X-ray defraction studies made on each composition indicated that amorphous metal alloy phases were formed where Ti was greater than 7 and only crystalline phases were observed where the Ti was less than 7. Therefore, the end point limit for Ti to stabilize an amorphous 304 stainless steel containing about 18 atom percent chromium is about 7 atom percent of Ti.

EXAMPLE V

Another sample with the composition $Fe_{50}Cr_{50}$ was prepared using the technique of Example I. The substrate was held at −196° C. during deposition. The deposit was crystalline. This indicates that without stabilizing elements amorphous iron-chromium alloys cannot be prepared by sputter deposition even on cold substrates.

EXAMPLE VI

Another sample having the composition $Fe_{61}Ni_9Cr_{17}W_{13}$ of 13 mils thickness was prepared by sputter deposition. Hardness measurements by the diamond pyramid method showed a hardness between 800–1100 kg/mm$^2$. The equivalent tensile strength of the material would be about 400,000–500,000 psi. The thermal stability of this material after heat treatment at 500° C. for 24 hours was determined by a transmission electron microscope (TEM). The material remained in the amorphous state but contained from 1 to 2% of fine crystals. The material was then heat treated at 600° C. for 24 hours. Examination by TEM showed the formation of a crystalline structure. Similar material was studied with a 1 million volt electron microscope to determine resistance to radiation damage. The radiation of electrons generated at 1 million volts at a current density of $1\times10^{\circ}$electrons/cm$^2$/sec is equivalent to 2 to 3 displacements per atom (dpa). The material at 60° C. did not show any change of microstructure. Examination of the alloy at 500° C. using a similar electron energy also did not show any recrystallization of the material.

From the preceding discussion and examples, it can be seen that the amorphous metal alloys of the invention, stabilized with the early transition elements, provide good corrosion resistance and high temperature stability for protecting less corrosion-resistant surfaces.

The embodiments of the invention in which an exclusive property or privilege is claimed are defined as follows:

1. An amorphous metal alloy capable of remaining amorphous at temperatures up to at least 400° C., consisting essentially of the formula $M_aCr_bT_c$, where M is at least one element selected from the group consisting of iron and nickel, T is at least one element selected from the group consisting of titanium, zirconium, hafnium, niobium, tantalum, molybdenum and tungsten and where a is 35 to 75 atom percent, b is 5 to 20 atom percent, c is 5 to 55 atom percent, and b and c are at least 25 atom percent.

2. A substrate coated with an amorphous metal alloy capable of remaining amorphous at temperatures up to at least 400° C., consisting essentially of the formula $M_aCr_bT_c$ where M is at least one element selected from the group consisting of iron and nickel, T is at least one element selected from the group consisting of titanium, zirconium, hafnium, niobium, tantalum, molybdenum and tungsten and where a is 35 to 75 atom percent, b is 5 to 20 atom percent, c is 5 to 55 atom percent, and b and c are at least 25 atom percent.

3. The amorphous metal alloy of claim 1 where M is both iron and nickel.

4. The amorphous alloy of claim 3 where T is selected from the group consisting of titanium and tungsten.

5. The amorphous alloy of claim 4 where iron is present from 32 to 65 atom percent, nickel is present from 3 to 6 atom percent, b is from 9 to 19 atom percent and c is from 10 to 50 atom percent.

6. The amorphous metal alloy of claim 1 wherein the alloy is prepared by sputter deposition onto a substrate cooled to below 100° C.

7. The substrate containing a coating of claim 2 where M is both iron and nickel.

8. The substrate containing a coating of claim 7 where T is selected from the group consisting of titanium and tungsten.

9. The substrate containing a coating of claim 8 where iron is present from 32 to 65 atom percent, nickel is present from 3 to 6 atom percent, b is from 9 to 19 atom percent and c is from 10 to 50 atom percent.

* * * * *